United States Patent [19]

Berry et al.

[11] 4,288,047

[45] Sep. 8, 1981

[54] FIREHOSE REEL AND TRANSFER DEVICE

[76] Inventors: Doyle R. Berry, 2509 Woodland Ct.; Walter S. Elder, 821 Morningside Dr., both of Jeffersonville, Ind. 47130

[21] Appl. No.: 156,069

[22] Filed: Jun. 3, 1980

[51] Int. Cl.[3] ..... B65H 75/38

[52] U.S. Cl. ..... 242/86

[58] Field of Search ..... 242/86, 86.1, 86.2, 242/67.1 R

[56] References Cited

U.S. PATENT DOCUMENTS

| | | | |
|---|---|---|---|
| 2,197,767 | 4/1940 | Neale | 242/86 |
| 2,815,180 | 12/1957 | Pratt | 242/86.1 |
| 3,124,321 | 3/1964 | Rylott | 242/86.2 |
| 3,184,180 | 5/1965 | Rockwell | 242/86 |
| 3,964,373 | 6/1976 | Christen | 242/67.1 R |

*Primary Examiner*—Edward J. McCarthy
*Attorney, Agent, or Firm*—Edward M. Steutermann

[57] ABSTRACT

A collapsed hose reel and transport device including first and second generally parallel spaced wall members of generally semi-circular configuration disposed in aligned relation, bracket means extending between first and second wall means along a portion of the length of periphery thereof to form a hose receiving chamber, at least two roller means located at the periphery of the wall means and disposed to extend across the chamber between the first and second wall means.

The devices can also include crank means to extend through the first wall means and with journal means in the second wall means to receive an end of the crank where the crank includes a forked end adapted to receive a collapsed hose between the tines thereof and where the crank means is adapted for rotation when in place extending between the first and second wall means for rolling collasped hose into a reel and where one of the roller members is disposed adjacent one end of the wall means so that hose to be introduced into the chamber rolls over the roller means.

Further, the device includes an arrangement where the roller means include peripherial groove means and plate means to extend transversly across the tub and received in the groove means of the roller means to accommodate hose means of selected width.

4 Claims, 8 Drawing Figures

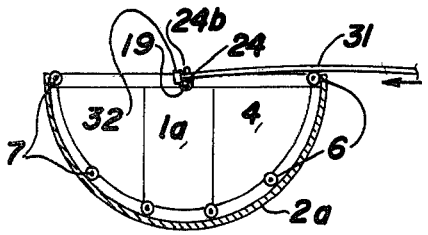
FIG 3a
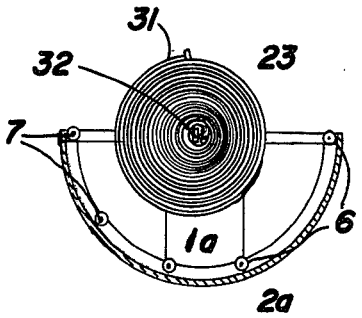
FIG 3b
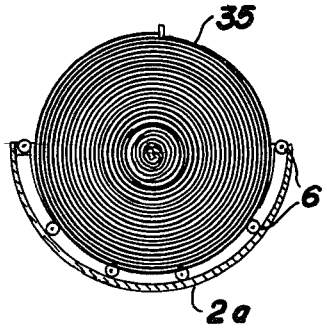
FIG.3c
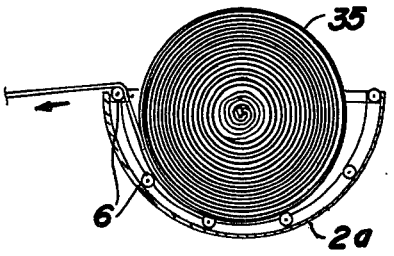
FIG 3d
FIG.4
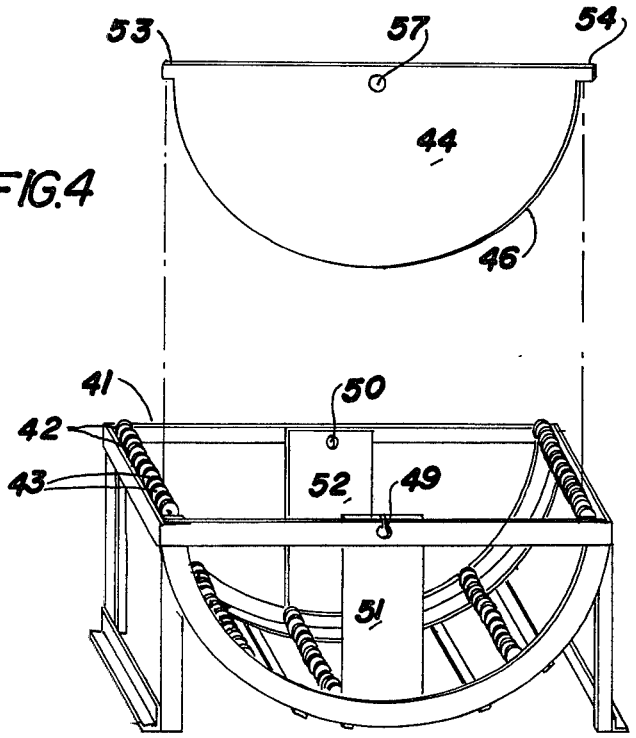
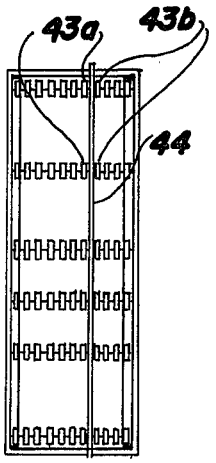
FIG.5

FIREHOSE REEL AND TRANSFER DEVICE

BACKGROUND OF THE INVENTION

The present invention relates to devices for reeling, holding, transporting, and unreeling collaspable hose particularly fire hoses. Fire hose typically comes in selected lengths, for example 50' lengths. After use the base must be cleaned, dried, sorted and then replaced on a fire truck. Specifically, after each use, upon return of the fire trucks to the fire house, the fire hose is throughly washed and hung in a hose tower or rack to dry. After the hose, which is bulky, is dried it must then be coiled and stored until it is necessary to replace the hose on a fire truck. The hose is typically coiled during storage and transported to the fire truck where it is unreeled into a straight length and placed on the truck.

Lengths of fire hose are quite heavy and bulky to handle. It has been found that the movement and unreeling of the firehose consumes considerable time and effort in the operation of a fire house.

Various arrangements are known for reeling a firehose as shown in U.S. Pat. No. 3,946,964-Zinzer, where a device is provided having a crank received between two arms with a guide means provided at the end of the arms to guide the hose to the crank. When the hose has been reeled, it is removed from between the guide means for storage.

A reel means without guide means is shown in U.S. Pat. No. 3,471,885—McLoughlin, and another reel arrangement is shown in U.S. Pat. No. 3,168,260—Kittelson.

A prior art hose cabinet is shown in U.S. Pat. No. 2,517,118—Lee, and likewise in U.S. Pat. No. 2,300,243—Zierden, as well as U.S. Pat. No. 1,488,364—Snyder, which does not provide means for removing the hose longitudinally from the storage cabinet.

Likewise, collapaible hose can be provided in varying diameter so that the collapsed hose can vary in width from 1½ inches to even 5 or 6 inches. No prior art device is known to accommodate winding an unwinding collapsible hoses of varying diameter.

SUMMARY OF THE INVENTION

The present invention provides inexpensive, straightforward devices for reeling, storing, transporting and unreeling a collapsible hose such as a fire hose.

Moreover, devices within the scope of the present invention provide means for reeling hose into a tub, utilizing the tub for storage or for transport of the hose to a storage location. Likewise the same tub can be utilized for moving the reeled hose from a storage location to the location where it is to be unwound where the tub provides means to facilitate unreeling.

More particularly, the present invention provides a transport and unreeling device for collapsed hose including first and second generally parallel spaced wall members of generally semi-circular configuration disposed in aligned relation, bracket means extending between the first and second wall members along a portion of the length of the periphery thereof to form a chamber between the first and second wall means, at least two roller means located in spaced relation above the periphery of the wall means and to extend across the chamber between the first and second wall means.

The devices can also include crank means to extend through the first wall means to journal means in the second wall means including a forked end means adapted to receive a collapsed hose between the tines thereof and where the crank means is adapted for rotation when in place extending between the first and second wall means for rolling the collasped hose into a reel and where one of the roller members is disposed adjacent one end of the wall means so that hose to be introduced into the chamber rolls over the roller means.

Likewise devices within the scope of the present invention can include arrangements wherein the roller means include peripheral groove means and plate means to extend transversly across the tub and adapted to be received in the roller groove means to selectively vary the width of the hose receiving portion of the tub means.

Various other arrangements also within the scope of the present invention will become obvious to those skilled in the art upon reading the disclosure set forth hereinafter.

One examples of an arrangement within the scope of the present invention is illustrated in the accompanying figures wherein:

BRIEF DESCRIPTION OF THE DRAWINGS

FIGS. 3*a*–3*d* are sequential illustrations of the use of the device shown in FIGS. 1 and 2;

FIG. 4 is a perspective view illustrating another arrangement within the scope of the present invention; and FIG. 5 is a top view of an assembled arrangement as shown in FIG. 4.

Referring now to FIG. 1 which shows a perspective view of an arrangement within the scope of the present invention, the device shown includes wall members 1*a* and 1*b* which in the arrangement shown do not completely cover the sides of the device. Bracket members 2*a* and 2*b* are of generally semi-circular configuration are shown which form the outer periphery of the wall members 1*a* and 1*b* and brackets 3 extend from brackets 2*a* and 2*b* between wall members 1*a* and 1*b* to define a chamber 4 therebetween.

Figure 1:
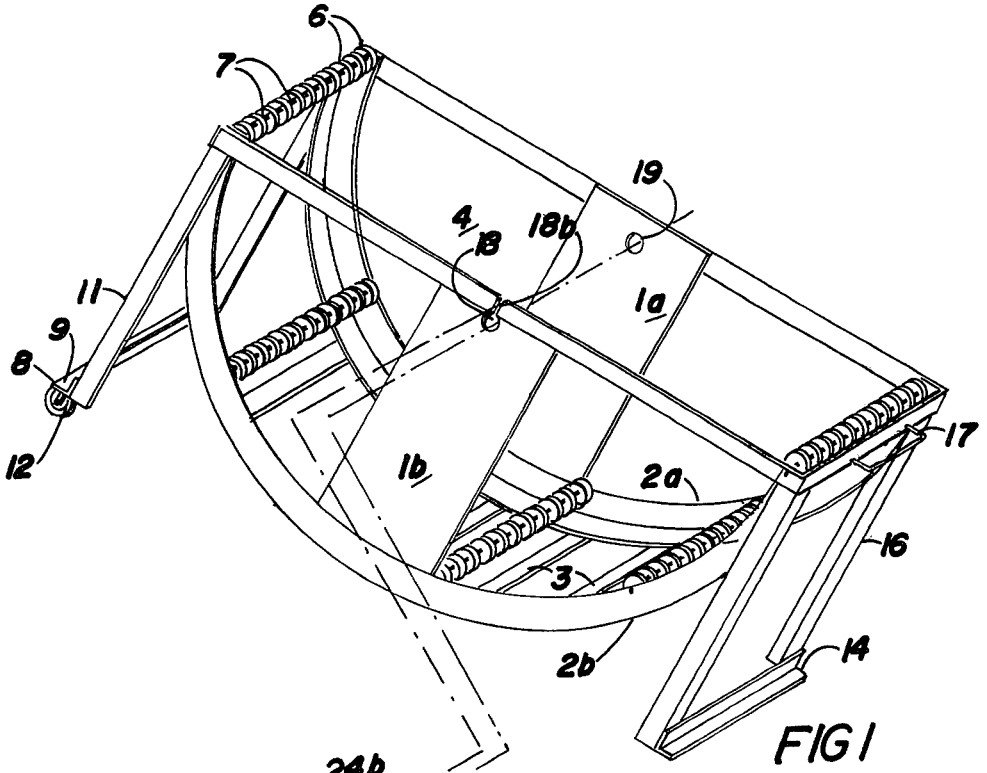
FIG. 1 is a perspective view, of a device within the scope of the present invention.

Within the scope of the present invention roller members, for example ball bearing roller members 6 are provided in spaced relation around the periphery of wall members 1*a* and 1*b* and as in the example shown, are received in brackets 2*a* and 2*b*. Advantageously, roller members 6 are freely rotatable on shafts 7 to facilitate in unwinding collapsed hose as discussed hereinafter.

In the arrangement shown, a chamber 4 of generally semi-circular configuration is defined between spaced wall members 1*a* and 1*b* which are retained in position by means of bracket 3 secured to brackets 2*a* and 2*b* respectively.

A roller arrangement 8 is provided including a bracket 9 secured to legs 11. A roller means 12 is provided on the underside of brackets 9 to facilitate movement of the device. At the opposite end a stabilizing bar 14 is provided and is carried by arms 16 as is known in the art, at the end of the device opposite roller means 8. A handle 17 is provided to facilitate lifting the one end of the device and movement of the device on rollers 12.

In an arrangement within the scope of the present invention shown in FIG. 1, opeing 18 of selected diameter is provided in wall member 1*b* and includes a keyway 18*b*. A co-operative opening 19 is provided in opposite wall member 2*a* to journal a crank as described hereinafter.

Figure 2:
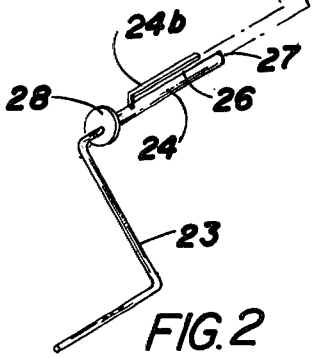
FIG. 2 is a perspective view of a crank arrangement which can be used in the device shown in FIG. 1.

FIG. 2 is an illustration of one crank device within the scope of the present invention of use in the device in FIG. 1. The device shown in FIG. 2 includes a crank 23 carrying a shaft 24 including a spaced bracket 24*b* where a hose receiving space 26 is defined therebetween. End 27 of shaft 24 is cooperatively adapted to be received in aperture 19 of wall member 1*a* and aperture 18 is also adapted to receive shaft 24 where bracket 24*b* is inserted through keyway 18*b* so the crank assembly can be rotatably retained in walls 1*a* and 1*b* with end 27 journaled in aperture 19.

A retainer 28 is provided on crank 23 to engage the outer periphery of wall member 1*b* around aperture 18 to selectively limit the extent of insertion of shaft 24 through chamber 4.

FIG. 3*a* is an illustration of a method for winding the collapsed hose 31 where the tub of FIG. 1 is shown in cross section. In FIG. 3*a*, hose 31 has been inserted through space 26 between shaft 24 and bracket 24*b* with the end 27 of the shaft 24 received in aperture 19 of wall member 1*a*. A coupling 32 is provided on hose 31 and is received on one side of the shaft 24 and bracket 24*b* to retain the hose within as shown. In FIG. 3*b* the crank has been turned until hose 31 is fully received within chamber 4 of the device. At this point the crank 23 is turned until bracket 24*b* is in aligned relation with keyway 18*b* shown in FIG. 1. Crank 23 is then removed from the device to release the coiled hose which can then be removed from the device for storage.

Devices within the scope of the present invention are also useful in uncoiling a hose, for example after a fire run prepartory to cleaning the hose or for loading cleaned hose into a truck. A coil of hose 32 as shown in FIG. 3*c* is placed in the chamber 4 of the device so the coil of hose rests on rollers 6 with coupling 32 extending out of the tub. The hose can hen be simply unreeled as shown in FIG. 3*d* when the reel of hose 32 rests on rollers 6 as the diameter of the reel diminishes.

Referring now to FIG. 4 which illustrates another arrangement within the scope of the present invention, a tub 41 similar to the arrangement shown in FIG. 1 is shown including rollers 42 having spaces 43 therebetween. In accordance with one feature of the present invention a planar panel 44 is provided having a semicircular periphery 46 of selected diameter.

The thickness of panel 44 is selected so that edge 46 of panel 44 can be received in spaces 43 between rollers 42 and the diameter of panel 44 is accordingly selected to permit entry of panel 44. An aperture 57 is provided in panel 44 to be located in aligned relation with apertures 49 and 50 of panels 51 and 52 of tub 1 where the diameter of aperture 45 is selected to accommodate rotation of a crank similar to crank 23 of FIG. 1. Outwardly extending lips 53 and 54 can be provided at the ends of panel 44 to engage the outer ends of tub 41, or the shaft carrying rollers 42 to prevent rotation of panel 44 in tub 41.

FIG. 5 is a top plan view of the arrangement shown in FIG. 4 with panel 44 in place. In the arrangement shown panel 44 has been located in tub 41 so that panel 44 is located between rollers 43*a*–43*b* of the sets of rollers to devise a space 56 of selected width to accommodate a hose of corresponding width.

It is to be understood that various other arrangements also within the scope of the present invention will occur to those skilled in the art upon reading of the disclosure set forth hereinbefore.

The invention claimed is:

1. A hose reel and transport device including first and second generally parallel wall means of generally semicircular peripherial configuration disposed in aligned relation, bracket means extending between the first and second wall means along a portion of the length of the periphery thereof to form a hose receiving chamber, at least two roller means located adjacent the periphery of the wall means and disposed to extend across the chamber between the first and second wall means.

2. The invention of claim 1 including co-operative aperature means located generally at the center of the first wall means and journal means disposed in aligned relation to said aperture in the second wall means, crank means including a crank arm having forked end means on the axial member of the crank arm wherein the fork means is adapted to receive a collapsed hose between the tines thereof and where the end of the fork means is adapted to be received in journal means and where the crank means is adapted for rotation when in place extending between the first and second wall means for rolling collapsed hose into a reel to be located partially within said chamber.

3. The invention of claim 2 wherein said crank arm forked end includes bracket means extending in spaced parallel relation from the shaft of said crank means.

4. The invention of claim 1 wherein at least two of said roller means includes spaced groove means in the periphery of said roller means and located in spaced parallel relation along the longitudinal axis of said roller means, and plate means adapted to be located within a chamber formed by said first and second members to extend across said chamber and to be received by the perpheral groove means of at least two of said roller means.

* * * * *